US011913753B2

(12) United States Patent
Bento et al.

(10) Patent No.: US 11,913,753 B2
(45) Date of Patent: Feb. 27, 2024

(54) LAUNCH RAIL TRANSPORT SYSTEM

(71) Applicant: Raytheon Company, Waltham, MA (US)

(72) Inventors: Joaquim A. Bento, Marlborough, MA (US); Samuel S. Han, Boston, MA (US); Michael R. Souliotis, Somerville, MA (US); Bruce F. Gogolen, Auburn, NH (US); Howard R. Kornstein, Lexington, MA (US); Michael V. Corbin, Marlborough, MA (US)

(73) Assignee: Raytheon Company, Tewksbury, MA (US)

( * ) Notice: Subject to any disclaimer, the term of this patent is extended or adjusted under 35 U.S.C. 154(b) by 121 days.

(21) Appl. No.: 17/655,596

(22) Filed: Mar. 21, 2022

(65) Prior Publication Data

US 2022/0373295 A1 Nov. 24, 2022

Related U.S. Application Data

(60) Provisional application No. 63/165,208, filed on Mar. 24, 2021.

(51) Int. Cl.
*F41F 3/04* (2006.01)

(52) U.S. Cl.
CPC ..... *F41F 3/0406* (2013.01)

(58) Field of Classification Search
CPC ..... F41F 3/00; F41F 3/052; F41F 3/06; F41F 3/08; F41F 3/0406; B64D 7/08; B64D 1/06
See application file for complete search history.

(56) References Cited

U.S. PATENT DOCUMENTS

| | | | | |
|---|---|---|---|---|
| 2,818,779 | A | 1/1958 | Koeper | |
| 3,528,691 | A * | 9/1970 | Matich, Jr. | F16D 1/0888 411/80 |
| 5,253,964 | A * | 10/1993 | Swemmer | E21D 20/00 411/79 |
| 5,353,677 | A * | 10/1994 | Kennedy | F41F 3/073 89/1.816 |
| 8,317,025 | B1 * | 11/2012 | Kolozs | F42B 39/22 89/1.816 |
| 8,887,613 | B1 | 11/2014 | Griffin et al. | |
| 2006/0022180 | A1 * | 2/2006 | Selness | A47B 91/028 254/104 |
| 2010/0314501 | A1 * | 12/2010 | Vauchel | F02C 7/04 244/53 B |
| 2012/0060674 | A1 | 3/2012 | Garrison et al. | |

OTHER PUBLICATIONS

PCT International Search Report and Written Opinion dated Jul. 26, 2022 for International Application No. PCT/US2022/021094; 13 Pages.
PCT International Preliminary Report on Patentability dated Oct. 5, 2023 for International Application No. PCT/US2022/021094; 8 Pages.

* cited by examiner

*Primary Examiner* — Benjamin P Lee
(74) *Attorney, Agent, or Firm* — Daly, Crowley, Mofford & Durkee, LLP

(57) ABSTRACT

Methods and apparatus for a brace for attachment to a launch rail for a projectile for distributing loading of the projectile when supported by the launch rail. A height of the brace can be adjusted to distribute loading. In embodiments, a release mechanism can allow movement of a wear plate during launch of the projectile.

18 Claims, 10 Drawing Sheets

LAUNCH RAIL TRANSPORT SYSTEM

CROSS REFERENCE TO RELATED APPLICATIONS

The present application claims the benefit of U.S. Provisional Patent Application No. 63/165,208, filed on Mar. 24, 2021, which is incorporated herein by reference.

BACKGROUND

As is known in the art, launch rails can be used to secure a projectile on an air-based or ground-based platform. As projectiles become heavier, the added weight may reduce the lifespan of conventional launch rails.

SUMMARY

Embodiments of the disclosure provide methods and apparatus for a brace that can be attached to launch rail(s) for supporting the rail without impacting how a projectile slides down the rail during launch. As the weight of improved projectiles increases, the loading on the front of the launch rail increases. This additional loading may increase wear out and potentially cause a structural failure in that area of the rail. In embodiments, a brace partially supports the weight of the missile and shifts load away from the front the rail so as to extend its lifespan as compared to conventional rail configurations.

Embodiments of a brace can be attached, e.g., by screws, to the rail. Because the brace is attached to the side of the rail in example embodiments, it does not interfere with projectile launch and does not need to be removed prior to launch. This alleviates emplacement and timeline issues and avoids significant safety/mission assurance issues. The brace can be configured to reduce stresses on the rail-to-projectile mechanical connections by partially lifting the projectile so as to redistribute the load so that the load is reduced at the front and rear of rail. The load redistribution allows for an overall lower stress condition thus extending the life of the rail. The inclusion of a quick release mechanism allows the projectile to launch without excess friction at the missile to brace interface.

In one aspect, a system comprises: a brace configured for attachment to a launch rail for a projectile, the brace comprising: a load distribution mechanism comprising: a wear plate for distributing loading of the projectile when supported by the launch rail; and a height adjustment assembly for receiving a force and adjusting a height of the wear plate.

A system can further include one or more of the following features: the height adjustment assembly comprises first and second wedge blocks, the height adjustment assembly comprises a height adjustment block having surfaces abutting respective surfaces of the first and second wedge blocks, a translation member to provide the force to the height adjustment assembly, the translation member comprises a threaded screw, the translation member further includes a proximal end to receive a rotational force and a distal end rotatably engaged with an end member for positioning the second wedge block, a torque limiter coupled to the translation member, the brace further includes a release mechanism configured to allow movement of the wear plate during launch of the projectile from an inactive position to an active position, the release mechanism comprises a bias member to bias the release mechanism to the inactive position, the wear plate moves in the same direction as the projectile during launch, and or the release mechanism comprises an elongate member for capturing the bias member.

In another aspect, a method comprises: configuring a brace for attachment to a launch rail for a projectile, the brace comprising: a load distribution mechanism comprising: a wear plate for distributing loading of the projectile when supported by the launch rail; and a height adjustment assembly for receiving a force and adjusting a height of the wear plate.

A method can further include one or more of the following features: the height adjustment assembly comprises first and second wedge blocks, the height adjustment assembly comprises a height adjustment block having surfaces abutting respective surfaces of the first and second wedge blocks, a translation member to provide the force to the height adjustment assembly, the translation member comprises a threaded screw, the translation member further includes a proximal end to receive a rotational force and a distal end rotatably engaged with an end member for positioning the second wedge block, a torque limiter coupled to the translation member, the brace further includes a release mechanism configured to allow movement of the wear plate during launch of the projectile from an inactive position to an active position, the release mechanism comprises a bias member to bias the release mechanism to the inactive position, the wear plate moves in the same direction as the projectile during launch, and or the release mechanism comprises an elongate member for capturing the bias member.

BRIEF DESCRIPTION OF THE DRAWINGS

The foregoing features of this disclosure, as well as the disclosure itself, may be more fully understood from the following description of the drawings in which.

DETAILED DESCRIPTION

Figure 1:
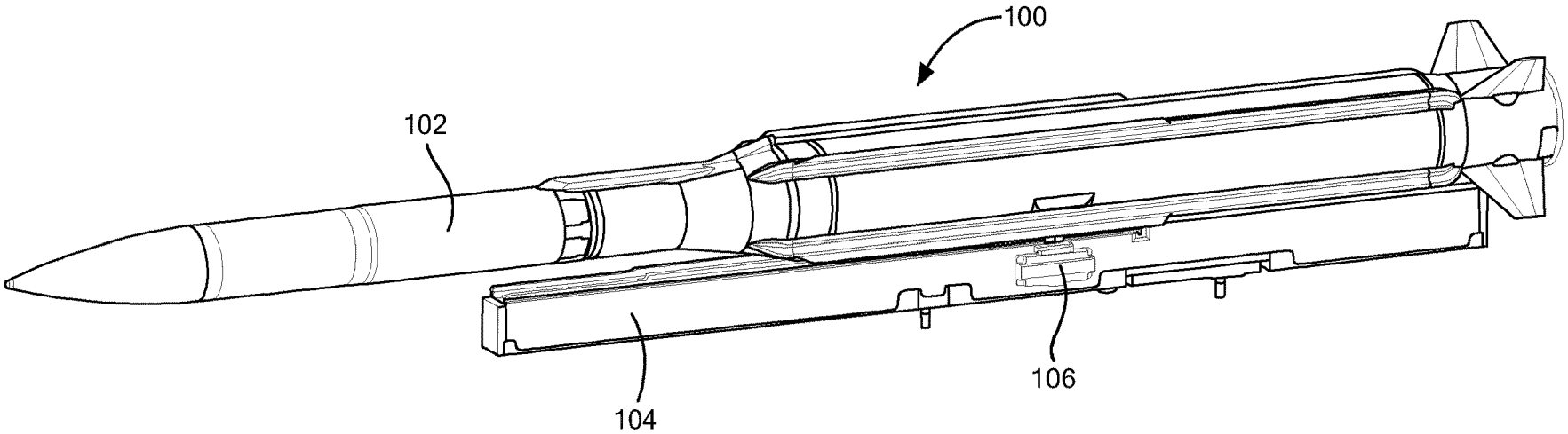
FIG. 1 is an isometric view of an example assembly including a brace attached to a launch rail supporting a projectile.

FIG. 1 shows an example projectile launch system 100 including an assembly of a projectile 102 supported by a rail system 104 and a brace 106 for distributing loading in accordance with example embodiments of the disclosure. The brace 106 has a first position in which the brace is not engaged with the projectile and a second position in which the brace is engaged with the missile to distribute load and reduce stress on the mechanical rail-to-projectile connection, as described more fully below.

Figure 2A:
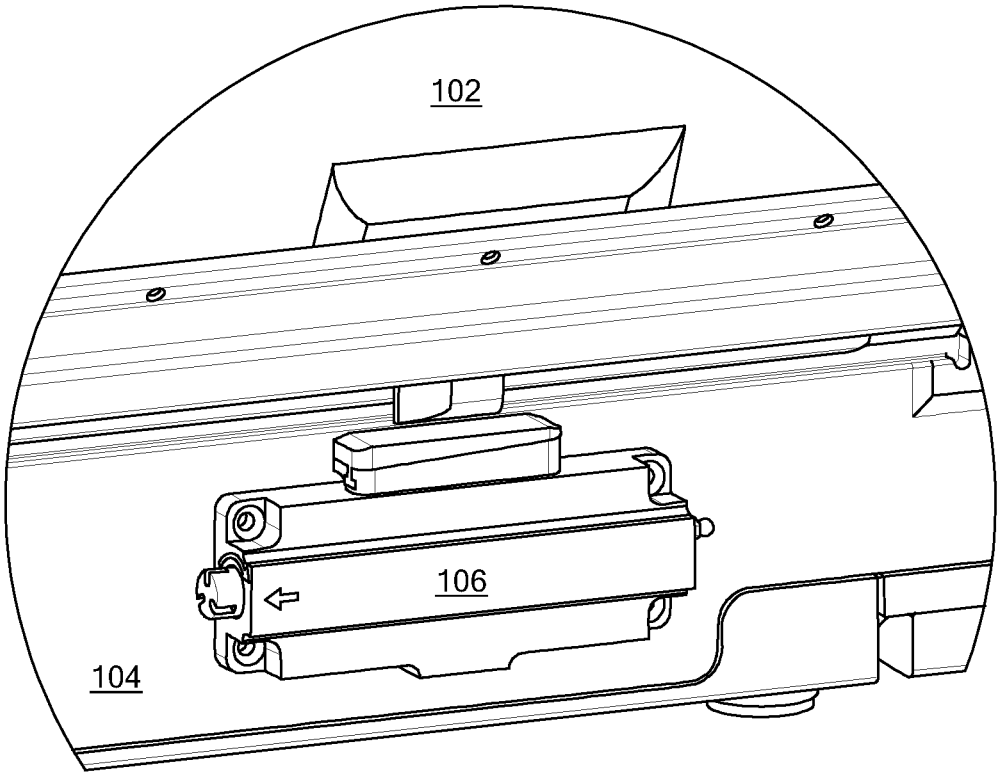
FIG. 2A is a side view of the brace of FIG. 1 in an unengaged position.
Figure 2B:
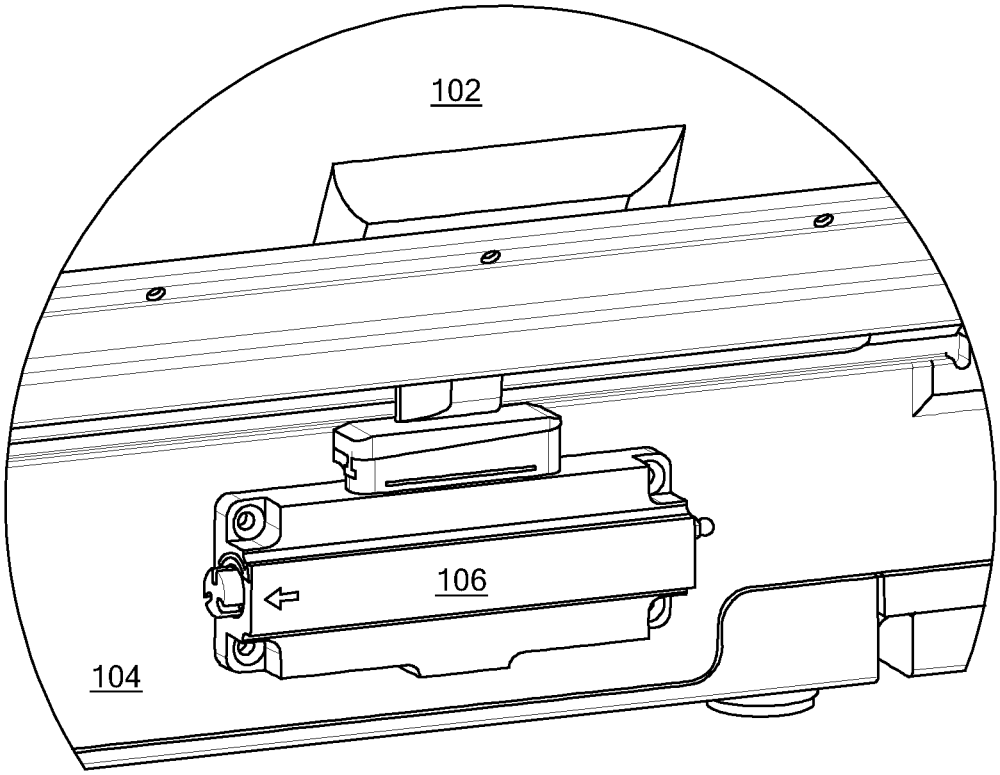
FIG. 2B is a side view of the brace of FIG. 1 in an engaged position.
Figure 2C:
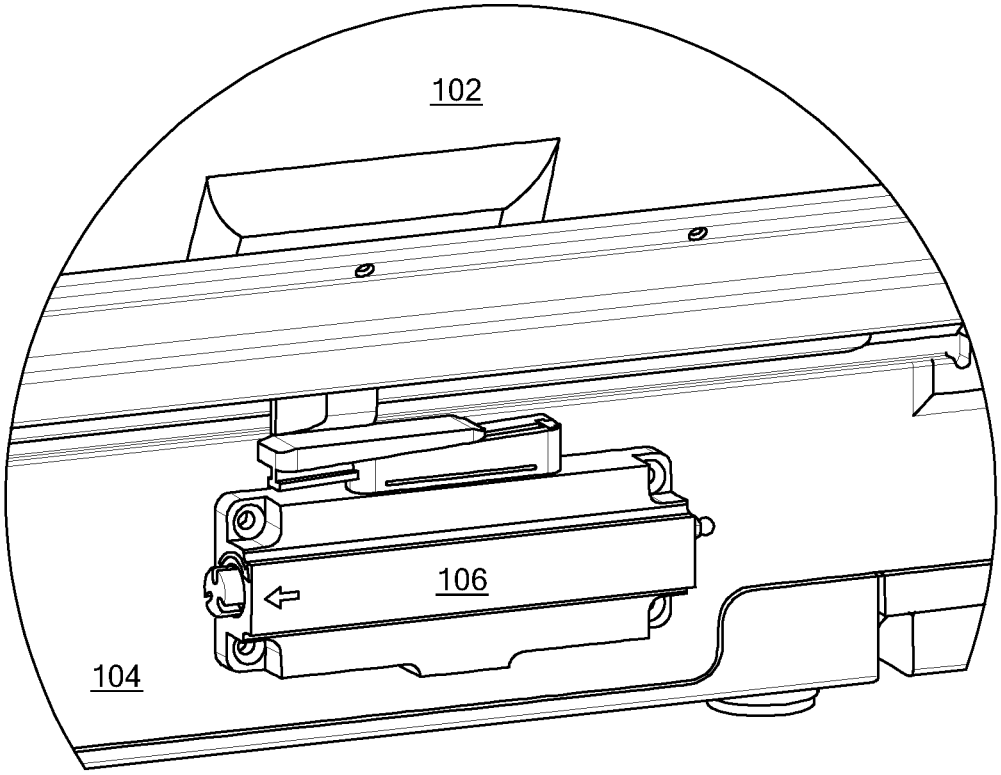
FIG. 2C is a side view of the brace of FIG. 1 during launch of the projectile.
Figure 3B:
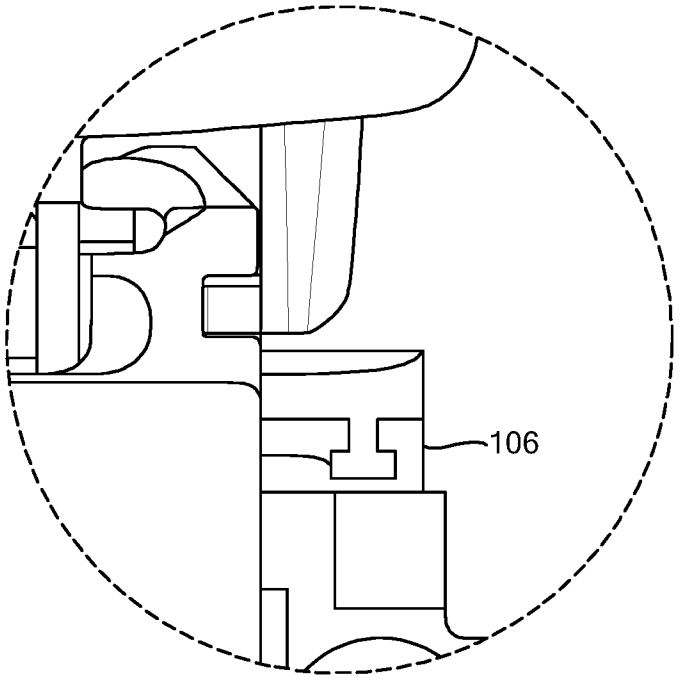
FIG. 3B is an enlarged view of a portion of the assembly of FIG. 3A.
Figure 3A:
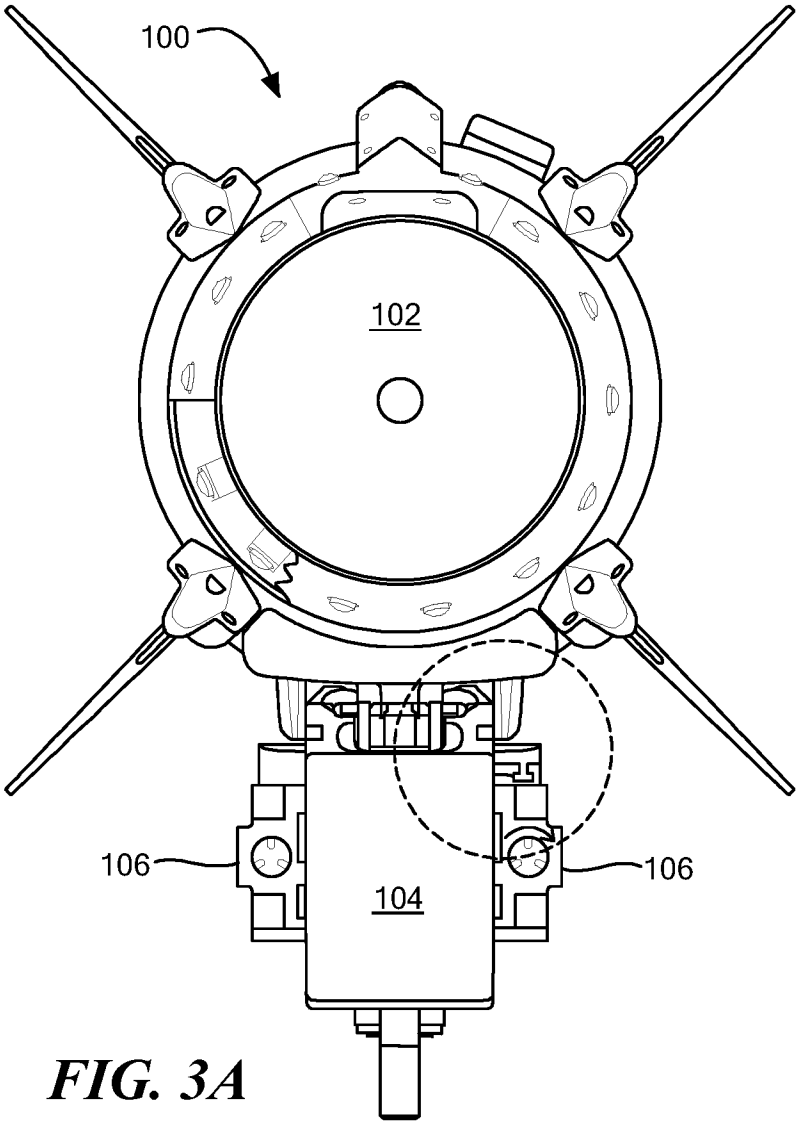
FIG. 3A is a front view of the brace, launch rail and projectile of FIG. 1 and FIG. 2A.
Figure 4B:
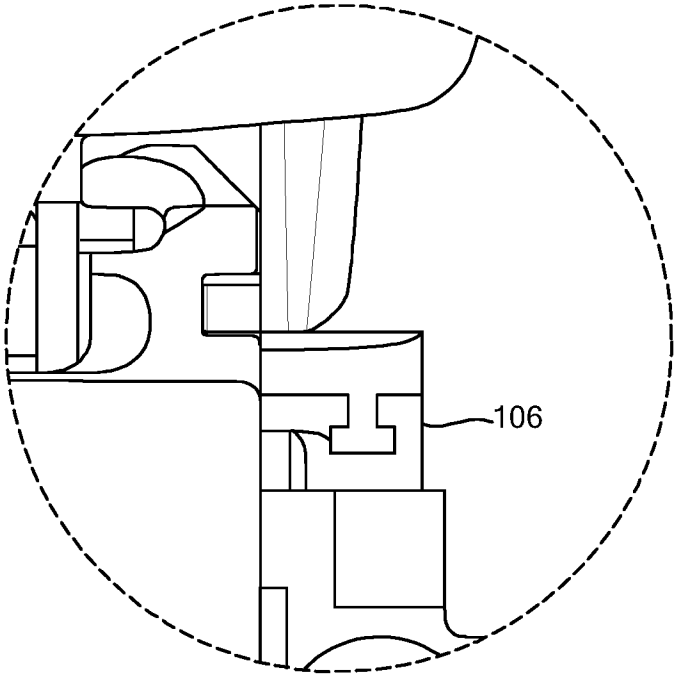
FIG. 4B is an enlarged view of a portion of the assembly of FIG. 4A.
Figure 4A:
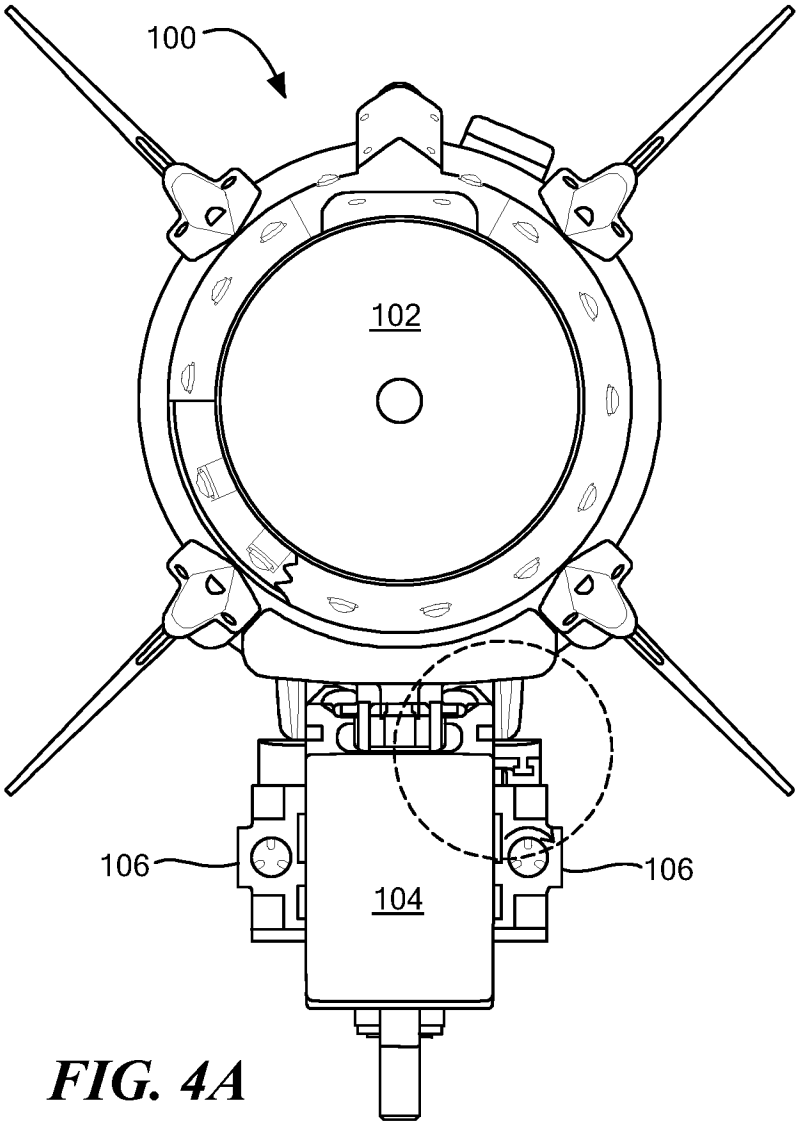
FIG. 4A is a front view of the brace, launch rail and projectile of FIG. 1 and FIG. 2B.

FIG. 2A shows the brace 106 in the first position unengaged with the projectile 102, FIG. 2B shows the brace in the second position engaged with the projectile, and FIG. 2C shows the brace in a third position during launch of the projectile, as described more fully below, where FIGS. 2A, 2B, and 2C are side views of the brace of FIG. 1. FIGS. 3A and 3B show the assembly of FIG. 1 with the brace 106 in the unengaged position and FIGS. 4A and 4B show the assembly of FIG. 1 with the brace in the engaged position in which loading is distributed.

Figure 5A:
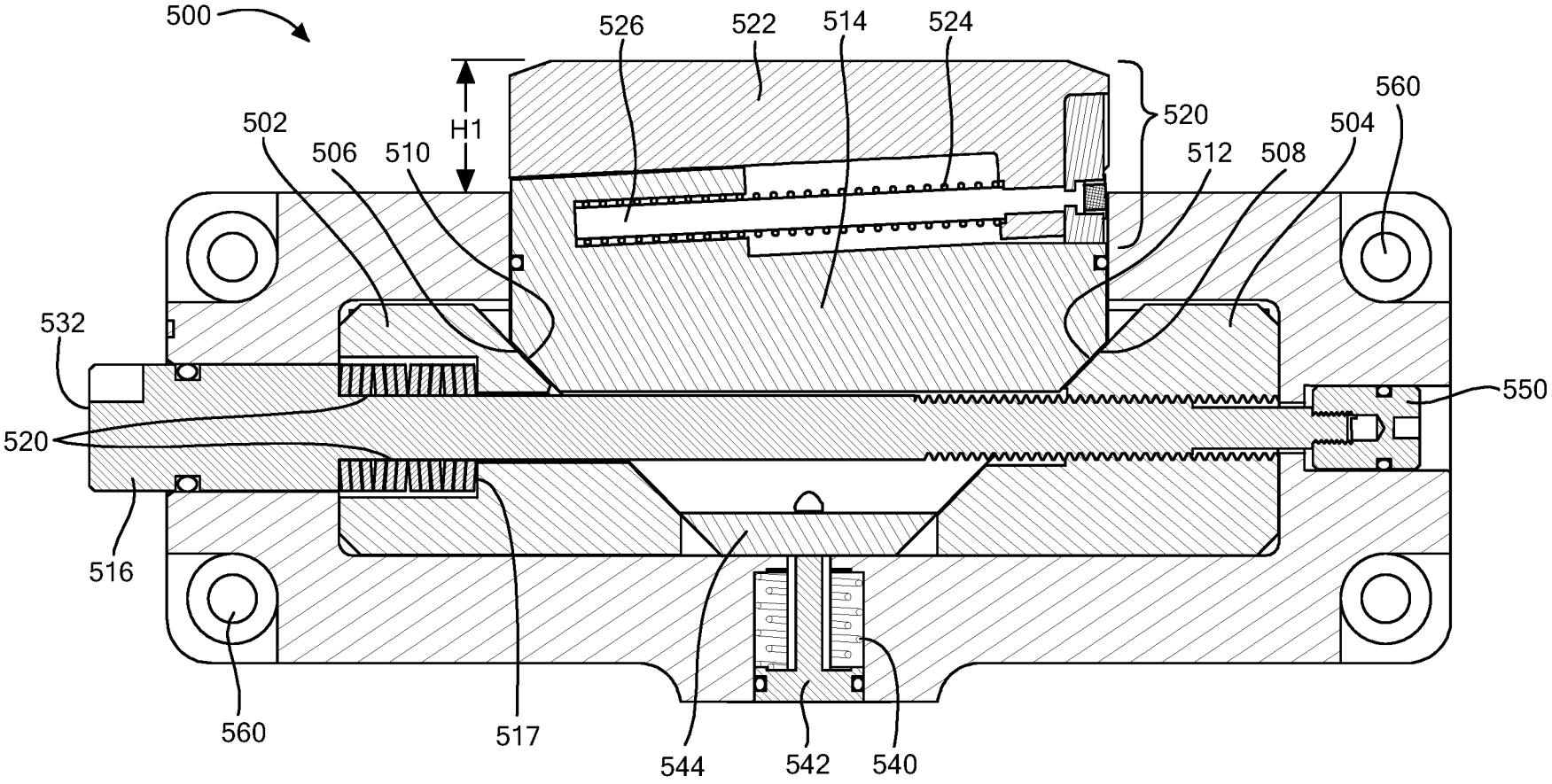
FIG. 5A is a cross-sectional view of the brace of FIG. 2A.

FIG. 5A is a longitudinal cross section of an example brace 500 that distributes loading of a projectile on a rail in accordance with example embodiments of the disclosure. The brace 500 is shown in an unengaged position. In example embodiments, the brace 500 includes first and second wedge blocks 502,504 placed in opposition with respective angled surfaces 506, 508 abutting complementary angled surfaces 510, 512 of a height adjustment block 514. A translation member 516 is engaged with at least one of the first and second wedge blocks 502, 504. In an example embodiment, a portion of the translation member 516, which may comprise a screw for example, is threadably engaged with the second wedge block 504. The first wedge block 502 may include a shoulder 517 to receive force from the translation member 516. Rotation of the translation member 516 in a first direction causes the first wedge block 502 to move closer to the second wedge block 504 and the second wedge block to move closes the first wedge block. In embodiments, a distal end of the translation member 516 can be coupled to a longitudinally movable end member 550. In some embodiments, or both of the wedge blocks may be fixed in position. In the first position, in which the brace is not distributing load, the top of a wear plate 522, which is described below, is set to a first height H1.

The height adjustment block 514 can include a release mechanism 520 to facilitate launching of a projectile, as described more fully below. In the illustrated embodiment, the release mechanism 520 includes a slidable wear plate 522 movable between a first position (FIGS. 5A and 5B) to a second position (FIG. 5C). A spring member 524, which can be captured by an elongate member 526, can bias the wear plate 522 to the first position.

A series of washers 530 can be placed at the intersection of the first wedge block 502 and the translation member 516. An optional torque limiter (not shown) can be provided between the first wedge block 502 and an end 532 of the translation member. In embodiments, a suitable tool can be used to engage and rotate the end 532 of the translation member 516.

An optional support mechanism 540 can be located under the wedge blocks 502,504 to maintain a selected height. The support mechanism 540 can include a bottom screw 542 that can be spring loaded to allow the center wedge 514 to be lowered when the device translation member is rotated in order to unload the device and move a support plate 544 to a reduced height.

A series of apertures 560 can be formed in the brace 500 to enable attachment to the rail or other structure. It is understood that any suitable mechanism can be used to attach the brace to a launch rail.

Figure 5B:
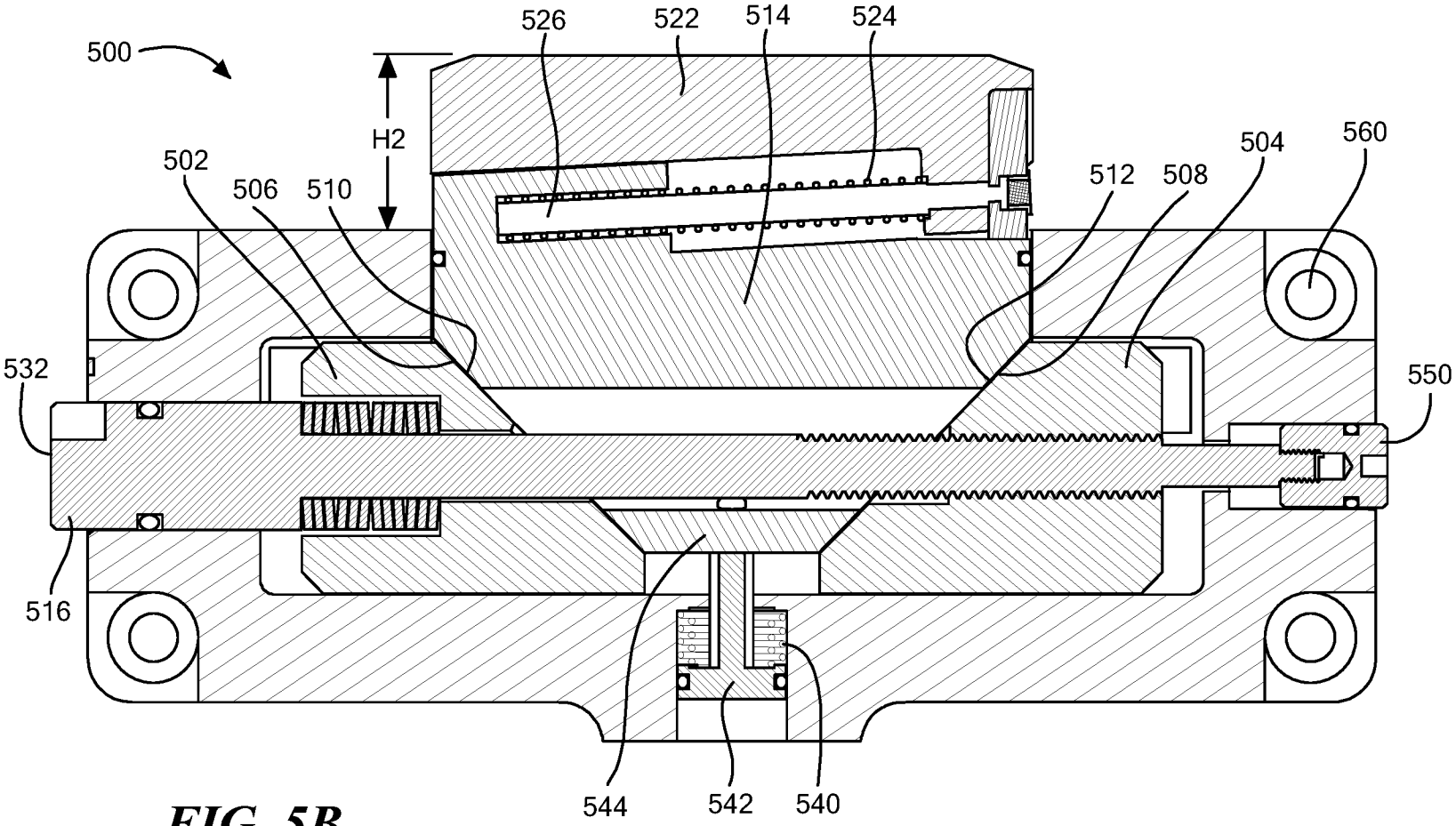
FIG. 5B is a cross-sectional view of the brace of FIG. 2B.
Figure 5C:
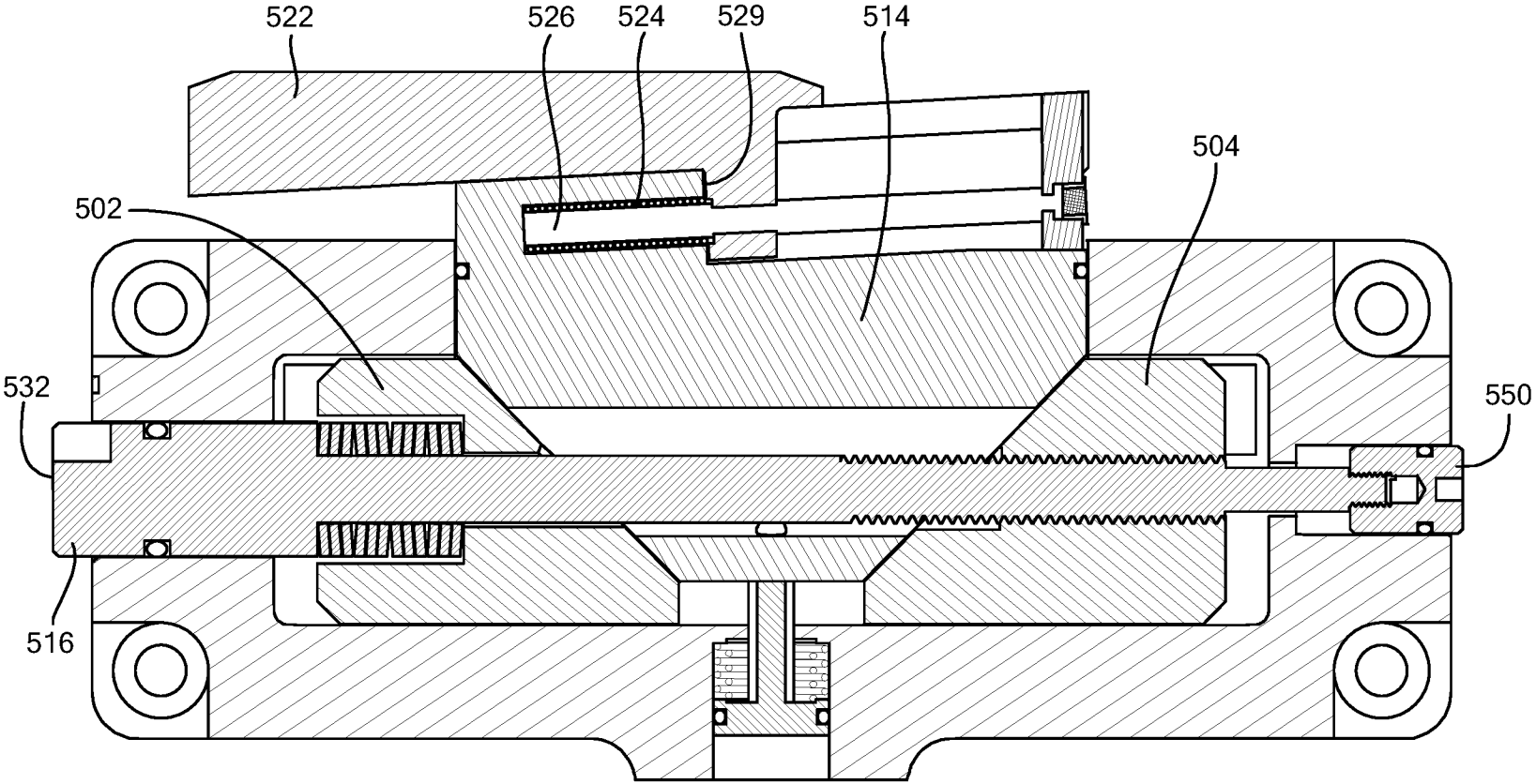
FIG. 5C is a cross-sectional view of the brace of FIG. 2C.

FIG. 5B shows the brace 500 in the second position in which the height adjustment block 514 is raised to distribute loading of a projectile. A transition to the second position from the first position is achieved by rotating the translation member 516 in the first direction to move the first and second wedge blocks 502, 504 closer together, which forces upward the height adjustment block 514 and wear plate 522. In the illustrated embodiment, in the second position, the top of the wear plate 522 is set to a second height H2, which is greater than the first height H1.

In an example embodiment, the end member 550 is threadably engaged to the distal end of the translation member 516. As the translation member 516 is rotated in the first direction, the second wedge block 504 is moved closer to the first wedge block 502. The first and second wedge blocks 502, 504 should move closer together at the same rate to push the adjustment block 514 evenly from both sides.

FIG. 5C shows the release mechanism 520 in an active position, which may occur during launch of the projectile. The slidable wear plate 522 is shown in moved forward from the default position shown in FIGS. 5A and 5B. The spring member 524, which held in position by the elongate member 526, is compressed in the active position by a shoulder 529 of the wear plate. After launch, the wear plate 522 is biased back to the inactive position by the spring member 524.

Figure 5D:
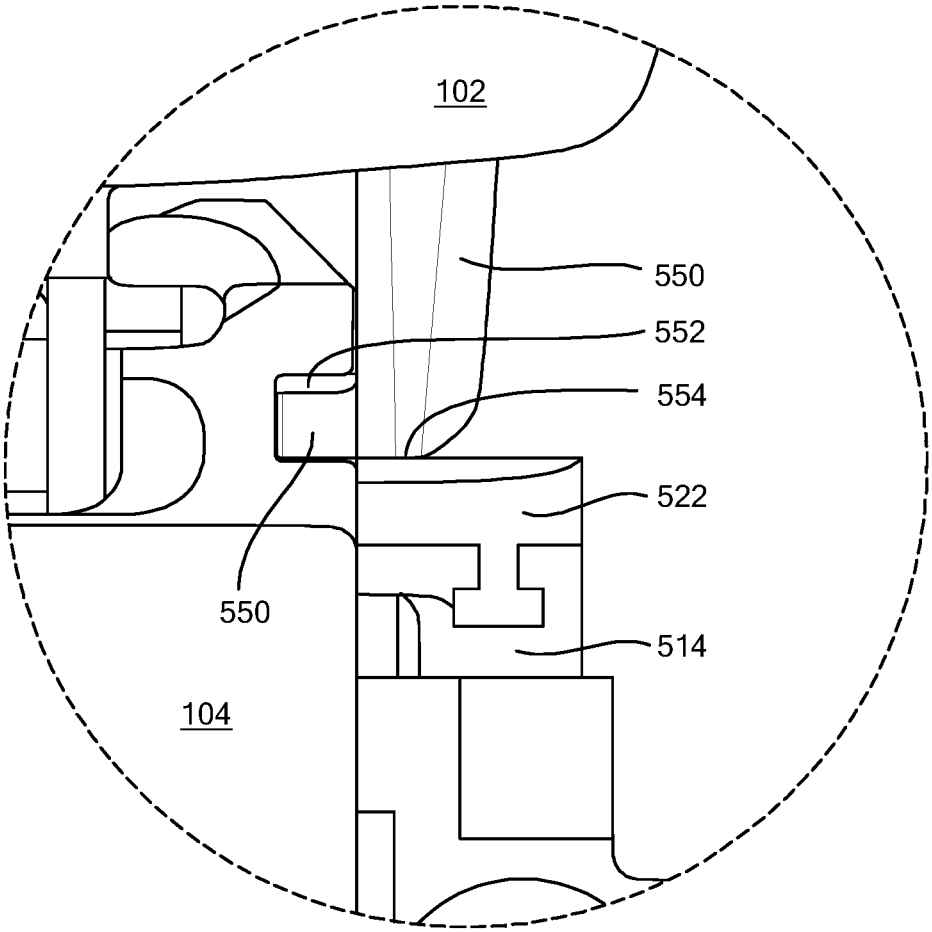
FIG. 5D is an enlarged view of FIG. 4B show load distribution by the brace.

FIG. 5D shows an enlarged view of FIG. 4B. The projectile 102 includes a series of fingers 550 that extend from a body of the projectile into respective channels 552 on each side of the launch rail 104. In the unengaged position shown in FIGS. 3A and 3B, for example, the brace does not contact the fingers 550 and does not distribute load. In the engaged position, in which the wear plate 522 is raised to the second height H2 (FIG. 5B), the wear plate contacts 554 the fingers 550 supports a portion of the load.

Figure 5E:
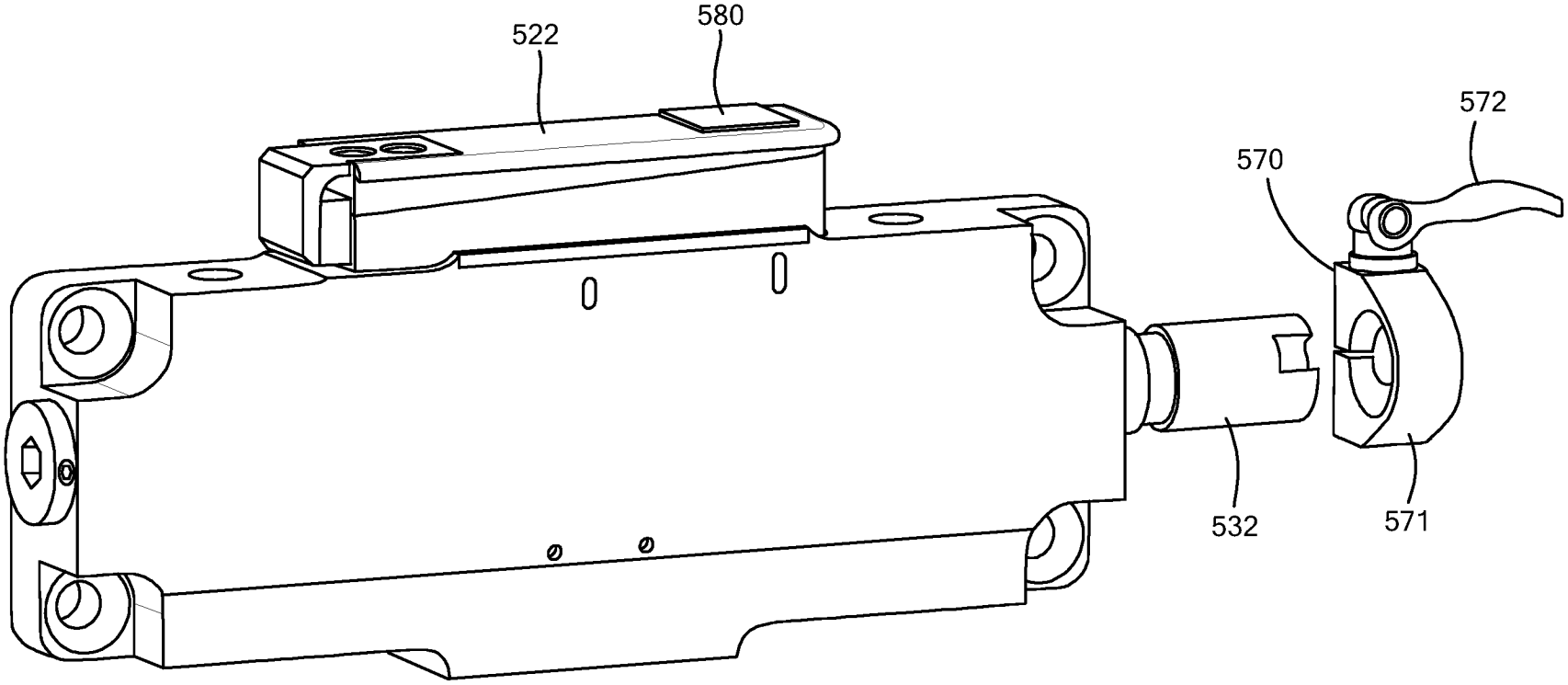
FIG. 5E is an isometric view of a height adjustment assembly having example vibration features.

FIG. 5E shows an example embodiment of a height adjustment block having additional features to mitigate the effects of vibration. In the illustrated embodiment, a rear raised protrusion 580, which may comprise part of the slidable wear plate 522, prevents longitudinal back out of the wear plate under vibration.

An optional mechanical lock 570 may prevent the translation member 532 from back driving (or loosening). In one particular embodiment, the mechanical lock includes a split ring clamp 571 with an integrated cam lever 572 to control clamping force. The mechanical lock 570 is configured to prevent loosening of leadscrew under harsh and extreme vibration conditions.

By distributing the load, the useful life of the rails can be extended. For example, aluminum launch rails used in combination with heavier projectiles benefit from the load distribution provide by example embodiments of a brace described herein. Furthermore, by positively engaging the underside of fingers 550, the system becomes stiffer driving the natural frequency of the system higher. With a higher natural frequency, the system avoids the lower frequency inputs that are more damaging to the system. The higher natural frequency also drives the system response to see lower G levels during transportation vibration, thus also lowering the stress levels at the forward and aft rail to missile interfaces.

Having described exemplary embodiments of the disclosure, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. A system, comprising:

a brace configured for attachment to a launch rail for a projectile, the brace comprising:

a load distribution mechanism comprising:

a wear plate for distributing loading of the projectile when supported by the launch rail;

a height adjustment assembly for receiving a force and adjusting a height of the wear plate; and a release mechanism configured to allow movement of the wear plate during launch of the projectile from an inactive position to an active position.

2. The system according to claim 1, wherein the height adjustment assembly comprises first and second wedge blocks.

3. The system according to claim 1, wherein the height adjustment assembly comprises a height adjustment block having surfaces abutting respective surfaces of the first and second wedge blocks.

4. The system according to claim 3, further including a translation member to provide the force to the height adjustment assembly.

5. The system according to claim 4, wherein the translation member comprises a threaded screw.

6. The system according to claim 4, wherein the translation member further includes a proximal end to receive a rotational force and a distal end rotatably engaged with an end member for positioning the second wedge block.

7. The system according to claim 4, further including a torque limiter coupled to the translation member.

8. The system according to claim 1, wherein the release mechanism comprises a bias member to bias the release mechanism to the inactive position.

9. The system according to claim 8, wherein the wear plate moves in the same direction as the projectile during launch.

10. A system, comprising:

a brace configured for attachment to a launch rail for a projectile, the brace comprising:

a load distribution mechanism comprising:

a wear plate for distributing loading of the projectile when supported by the launch rail;

a height adjustment assembly for receiving a force and adjusting a height of the wear plate; and a release mechanism configured to allow movement of the wear plate during launch of the projectile from an inactive position to an active position, wherein the release mechanism comprises a bias member to bias the release mechanism to the inactive position and an elongate member for capturing the bias member.

11. A method, comprising:

configuring a brace for attachment to a launch rail for a projectile, the brace comprising:

a load distribution mechanism comprising:

a wear plate for distributing loading of the projectile when supported by the launch rail;

a height adjustment assembly for receiving a force and adjusting a height of the wear plate; and a release mechanism configured to allow movement of the wear plate during launch of the projectile from an inactive position to an active position.

12. The method according to claim 11, wherein the height adjustment assembly comprises first and second wedge blocks.

13. The method according to claim 11, wherein the height adjustment assembly comprises a height adjustment block having surfaces abutting respective surfaces of the first and second wedge blocks.

14. The method according to claim 13, further including a translation member to provide the force to the height adjustment assembly.

15. The method according to claim 14, wherein the height adjustment assembly includes a mechanical lock to prevent the translation member from loosening.

16. The method according to claim 14, wherein the translation member further includes a proximal end to receive a rotational force and a distal end rotatably engaged with an end member for positioning the second wedge block.

17. The method according to claim 14, further including employing a torque limiter coupled to the translation member.

18. The method according to claim 11, wherein the release mechanism comprises a bias member to bias the release mechanism to the inactive position.

* * * * *